US007232195B2

(12) United States Patent
Yang

(10) Patent No.: US 7,232,195 B2
(45) Date of Patent: Jun. 19, 2007

(54) DRAWER STOP DEVICE

(75) Inventor: Tony Shuikuan Yang, Gahanna, OH (US)

(73) Assignee: American Signature, Inc., Columbus, OH (US)

( * ) Notice: Subject to any disclaimer, the term of this patent is extended or adjusted under 35 U.S.C. 154(b) by 368 days.

(21) Appl. No.: 10/837,931

(22) Filed: May 3, 2004

(65) Prior Publication Data

US 2005/0242691 A1 Nov. 3, 2005

(51) Int. Cl.
*A47B 88/00* (2006.01)
*A47B 95/00* (2006.01)

(52) U.S. Cl. ..... 312/333

(58) Field of Classification Search ..... 312/330.1, 312/333, 334.1, 334.6, 334.7, 334.8, 334.44, 312/334.46; 292/92, 95, 130, DIG. 65, DIG. 22
See application file for complete search history.

(56) References Cited

U.S. PATENT DOCUMENTS

| | | | | | |
|---|---|---|---|---|---|
| 3,397,001 | A * | 8/1968 | Friedman | 292/87 |
| 3,639,028 | A | 2/1972 | Black | 312/348 |
| 3,801,143 | A * | 4/1974 | Gutner | 292/76 |
| 4,392,697 | A | 7/1983 | Kousens | 312/348 |
| 4,437,715 | A | 3/1984 | Jenkins | 312/348 |
| 4,449,766 | A | 5/1984 | Shook | 312/348 |
| 4,505,526 | A | 3/1985 | Leck | 312/333 |
| 5,243,736 | A | 9/1993 | Cannaday et al. | 16/82 |
| 5,246,284 | A | 9/1993 | Merzon | 312/107 |
| 5,445,451 | A * | 8/1995 | Harmony | 312/333 |
| D371,951 | S * | 7/1996 | Rabo et al. | D8/323 |
| 5,795,044 | A | 8/1998 | Trewhella, Jr. et al. | 312/333 |
| 5,823,649 | A | 10/1998 | Hinrichs | 312/334.45 |
| 6,250,730 | B1 * | 6/2001 | Roth et al. | 312/333 |
| 2003/0173879 | A1 | 9/2003 | Mizrahi | 312/330.1 |
| 2003/0184197 | A1 | 10/2003 | Lai | 312/333 |

* cited by examiner

*Primary Examiner*—Janet M. Wilkens
*Assistant Examiner*—Timothy M. Ayres
(74) *Attorney, Agent, or Firm*—Wood, Herron & Evans, LLP

(57) ABSTRACT

A drawer stop device for use in furniture assemblies, such as dressers, cabinets, hutches, night tables, coffee tables, desks, entertainment centers and the like having drawers therein, the device includes a cam member configured for attachment to the underside of a drawer, the cam having a rearwardly and downwardly front facing cam surface, and a cantilever arm having a front mounting section configured for attachment to the lower frame member of the drawer opening and a rear deflectable section terminating in a free end, the deflectable section having an upwardly extending curved surface between the free end and the mounting section, wherein the arm when attached to the frame member of the drawer opening and cam when attached to the underside of the drawer are configured such that the cantilever arm hump is positioned in the path of travel of the front cam surface of the cam when the drawer is opened and to frictionally engage the cam when the drawer is at its extended normal open position from the opening under normal drawer opening forces and deflects the cantilever arm downward allowing the cantilever arm hump to slide along the lower most surface of the cam when forces are applied to the drawer in excess of normal drawer opening forces, thereby enabling complete withdrawal of the drawer from the opening.

13 Claims, 2 Drawing Sheets

DRAWER STOP DEVICE

BACKGROUND OF THE INVENTION

1. Field of the Invention

The invention generally relates to mechanisms for preventing the inadvertent complete withdrawal of a drawer from the front of a piece of furniture, such as a desk, chest, or the like, and, in particular, to a drawer stop device which prevents complete removal of the drawer without exertion of additional pulling force in excess of that required to merely open the drawer for access to its contents.

2. Description of the Prior Art

Many types of furniture, such as a dresser, a cabinet, desk, or an entertainment center, have one or more removable drawers therein. The drawers are generally guided into and out of a corresponding drawer opening in the framework of the furniture by sliding along a guide rail or other guiding means. Such guide means generally include two drawer guide components, the first of which is typically mounted to the drawer and generally positioned longitudinally from the front to the rear of the drawer and centrally located either underneath the drawer or along the side walls of the drawer. The second drawer guide component is usually mounted to the furniture frame defining the drawer opening and positioned either along a corresponding bottom or side surface of the framework of the opening such that it is configured to engage or receive the first drawer guide component. Access to the interior of the drawer is gained by advancing the front of the drawer outwardly along the guide means beyond the drawer opening, a distance sufficient to expose the drawer's contents. The drawer may generally be completely removed from the drawer opening by simply sliding the drawer further outwardly such that the rear of the drawer leaves the guide means and passes outwardly beyond the drawer opening.

Occasionally, a drawer is unintentionally or inadvertently completely withdrawn from the drawer opening in the furniture piece. Such occurrence is typically a nuisance and can possibly result in a painful experience, frequently including injury, and/or damage, should the drawer fall on a person or object. Accordingly, drawer stopping mechanisms have been designed and developed to prevent such accidental complete withdrawal of a drawer. Various mechanisms have been proposed which involve the use of a single drawer stop structure affixed to the inner surface of the rear wall of the drawer and having a portion raised above its upper edge which is configured to contact the top frame of the drawer opening upon full extension, thereby preventing the drawer from inadvertently falling out of the drawer opening. U.S. Pat. Nos. 3,639,028 and 4,392,697 disclose such drawer stops.

Other proposed drawer stop mechanisms involve the use of two interacting components, one positioned either on the side wall or bottom of the drawer and the other positioned on the frame of the drawer opening. These mechanisms require manual manipulation of one or both components by the user in order to completely withdraw the drawer from the furniture piece. For example, U.S. Pat. Nos. 4,505,526 and 5,795,044 disclose such devices wherein one component, attached to the drawer, must be depressed to avoid mechanical interference with a detent structure attached to the frame of the furniture.

Yet other proposed mechanisms, such as those disclosed in U.S. Pat. No. 5,243,736 and U.S. Patent Application Publication No. 20030184197, involve drawer stopping mechanisms having a single structural component attached generally to the underside of the drawer and configured to engage with a parting rail, laterally disposed relative the direction of drawer motion and typically part of the frame of the drawer opening, to resist further removal of the drawer.

While the previously proposed methods of preventing inadvertent, complete drawer removal have been useful to varying extents, they have not been entirely satisfactory for one or more reasons, such as complexity, unreliability, etc.

SUMMARY OF THE INVENTION

The present invention provides a new drawer stop device for use on removable drawers in furniture assemblies including, without limitation, dressers, cabinets, hutches, night tables, coffee tables, desks, entertainment centers and the like. A preferred drawer stop device in accordance with the invention is a mechanism generally including at least two structural components. The first component in a preferred embodiment is a cam having a generally planar front surface inclined downwardly and rearwardly with respect to its bottom surface which is, in a preferred embodiment, generally horizontally disposed. The cam is generally made of a suitable non-compressive, nonresilient material, such as wood, metal, or plastic. The cam is secured to the underside of the drawer, such as to the guide rail attached thereto and/or to the bottom of the drawer, generally proximate the rear of the drawer, and is oriented such that the inclined surface slopes downwardly, away from the bottom of the drawer, towards the rear thereof.

The second component is an elongated cantilever arm having a front mounting section and a rear deflectable section, and is formed of a resilient material, such as plastic, metal and the like, which renders the arm flexible and deflectable. The rear deflectable section includes an upwardly extending curved portion or "hump" and terminates in a rearwardly and downwardly facing free end. The front mounting section is secured to the lower front frame portion of the drawer opening such that the cantilever arm extends in a rearwardly direction with the "hump" extending above the plane of the lowermost surface of the cam, which is attached to the underside of the drawer. The arm may further include other features, such as a downwardly extending detent or finger located rearwardly of the mounting section and configured to abut the frame of the drawer opening such that the arm is prevented from moving forwardly during forcible withdrawal of the drawer.

The cam and the cantilever arm initially engage one another at a point in the travel of the drawer which coincides with the drawer extended to its normal open position, thereby resisting further removal of the drawer beyond its normal open position. The cam and cantilever arm are generally positioned such that the hump in the cantilever arm is in the path of travel of the inclined front cam surface of the cam and the cam abuts the arm's hump when the drawer is withdrawn to a desired open position, thereby preventing the drawer from being fully opened and ultimately removed when subjected to only opening forces of normal magnitude associated with opening a drawer. To further open or remove the drawer, the resistance provided by initial abutment of the cam surface of the cam and the cantilever arm hump can be overcome with additional drawer pulling force sufficient to cause the inclined front surface of the cam to forcibly deflect downwardly the "humped" portion of the resilient, flexible cantilever arm, thereby allowing the hump to pass beneath and in sliding contact with the lowermost surface of the cam and the drawer to be completely withdrawn from the opening of the furniture frame.

The drawer stop device may optionally include a third structural component, namely, a substantially non-compressible stop member such as a block, stationarily mounted on a dustpan surface, which generally forms the floor of the drawer opening, at a point below the free end of the cantilever arm. The height of the block is selected to limit the downward movement of the free end of the cantilever arm to a point coincident with the lowermost surface of the cam, thereby more accurately controlling the force required to fully withdraw the drawer from the furniture opening after the initial restraining engagement which occurs when the cam surface of the drawer-mounted cam strikes the cantilever arm hump, coinciding with withdrawal of the drawer to its normal, fully open position.

BRIEF DESCRIPTION OF THE DRAWINGS

Other features and advantages of the present invention will become apparent in the following detailed description of the exemplary embodiments with reference to the accompanying drawings, in which.

DETAILED DESCRIPTION OF THE DRAWINGS

The invention will be further appreciated in light of the following definitions:

The terms "furniture" and "furniture assembly", as used herein, are intended to generally refer to pieces of furniture including at least one fully removable drawer. These terms encompass free-standing pieces as well as built-in furniture pieces. Examples of "furniture" and "furniture assemblies" contemplated herein include, without limitation, dressers, night tables, coffee tables, hutches, desks, toolboxes, work benches, entertainment centers, built-in cabinets such as kitchen cabinets, wall cabinets, and the like.

The term "deflectable", as used herein with respect to the cantilever arm, is intended to generally refer to movement, such as bending, of the rear section without a substantial change in the configuration or shape of the rear section of the cantilever arm. Thus, the curvature of the humped portion remains substantially unchanged during deflection of the arm.

The term "hump" as used herein with respect to the cantilever arm, is intended to generally refer to an upwardly extending curved surface of the arm which projects above the front mounting section and free end of the deflectable section. As such, the curvature may vary in radius or degree of curvature, maximum height, and length relative the mounting section of the cantilever arm and the free end of the deflectable section of the arm.

Figure 1:
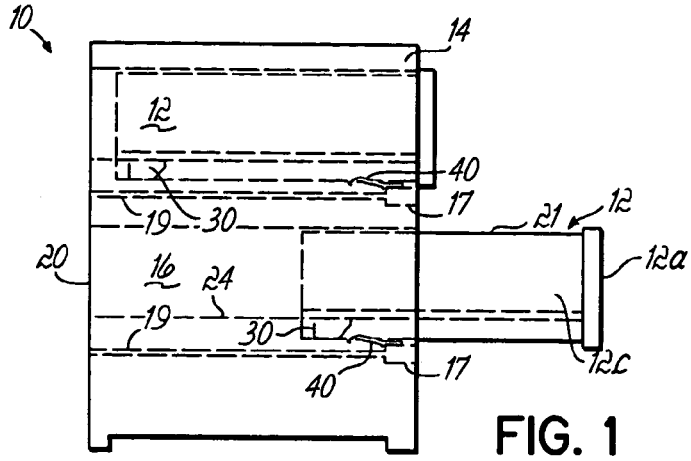
FIG. 1 is a side elevational view of a furniture piece having a first exemplary embodiment of the drawer stop device in accordance with the present invention.
Figure 2:
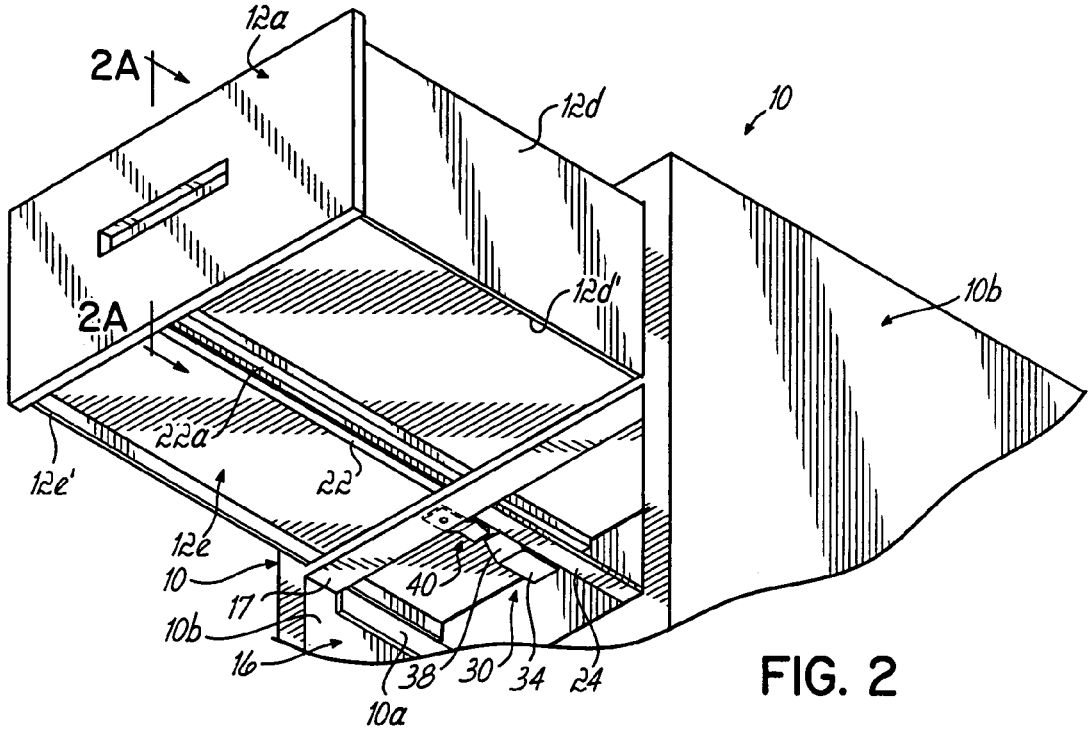
FIG. 2 is a cut-away, cross-sectional view of the closed drawer illustrated in FIG. 1.

The present invention provides a drawer stop device for use on various types of drawer-containing furniture to prevent accidental and unwanted complete removal of a drawer from the furniture frame. Referring to FIG. 1, there is shown a furniture assembly 10 incorporating a plurality of removable drawers 12. Furniture assembly 10, in a preferred embodiment, is a dresser which generally includes a furniture frame 14 having at least one drawer opening 16 for receiving at least one drawer 12. Frame 14 generally includes frame members located above, below, and on both sides of each opening 16. With reference to FIG. 2, there is shown, in a cut-away, close-up perspective view, a partially opened drawer 12. The drawer 12 includes a vertical front 12*a*, a vertical rear 12*b*, vertical left and right sides 12*c* and 12*d*, and a horizontal bottom 12*e*. A rail guide 22 extending transverse to opening 16, is mounted centrally to the lower surface of the bottom 12*e* of drawer 12, from front to the rear of drawer. Dresser 10 also includes a stationary rail 24 attached to the lower front frame 17 defining the lower portion of opening 16 and typically extending to the rear wall 50 of dresser. Rail 24 slidingly engages a slot 22*a* formed in the bottom of rail guide 22 during movement of drawer 12 (FIG. 2). Rail guide 22 also typically allows drawer 12 to be completely removed from dresser 10, where no other interfering drawer stop structures are present. While dresser 10 includes drawer 12 having a single central rail guide 22 to guide movement of drawer 12 into and out of opening 16, multiple guiding means, such as multiple rail guides, may be employed for wider and/or heavier drawers 12. The lower edges 12*e*' and 12*d*' of drawer sides 12*e* and 12*d* are supported, and slidingly engaged, by the upper surfaces of parallel, horizontal, support rails 10*a*, only of which is shown in FIG. 2. Support rails 10*a* are mounted to the inside surfaces 10*b* of the dresser sides 10*c* at vertical locations selected such that the upper edges of the rails 10*a* are slightly above the upper surface 12*a* of the front frame member 17, thereby providing a slight clearance between upper frame member surface 17*a* and the lower edges 12*e*' and 12*d*' of the drawer sides 12*e* and 12*d* when the drawer slides on support rails 10*a*.

The exemplary embodiment of the drawer stop device illustrated in FIGS. 1 and 2 is shown from the drawer's underside, with dustpan 19 (FIG. 2A) removed from view. As shown the drawer stop device generally includes a cam, such as cam block 30, secured to the underside portion of drawer 12. Cam block 30 is fixedly mounted to the bottom of drawer 12 proximate or adjacent the rear of drawer 12. Block 30 may be mounted directly to the bottom surface of drawer bottom 12*e* and/or to one of the vertical sides of the rail guide 22 secured to the bottom 12*e* of drawer 12. Alternatively, if the rear wall 12*b* of drawer 12 extends below the drawer bottom 12*e*, block 30 can be mounted to the front surface of the lowermost portion of the rear wall. Cam block 30 may be formed of any desired substantially nonresilient, non-compressive material, such as wood. Cam block 30 includes a substantially flat bottom surface 34, a substantially flat top surface 36 (FIG. 2), and a substantially planar, inclined front cam surface 38 sloping downwardly and rearwardly relative to the lower surface 12*e*' of drawer bottom 12*e*. Block 30 further includes a rear surface and two side surfaces, the configuration of which is not critical to the invention, as appreciated by persons of ordinary skill in the art. The inclination of sloping front cam surface 38 may vary as desired. Preferably, the front cam surface 38 is inclined at an angle 35 ranging from about 30° to 50° relative the bottom surface of drawer 12. In the preferred embodiment illustrated in FIG. 2, front surface 36 is inclined at an angle 35 of about 30° relative the bottom surface of drawer 12 (also relative bottom surface 34 of block 30).

Figure 2A:
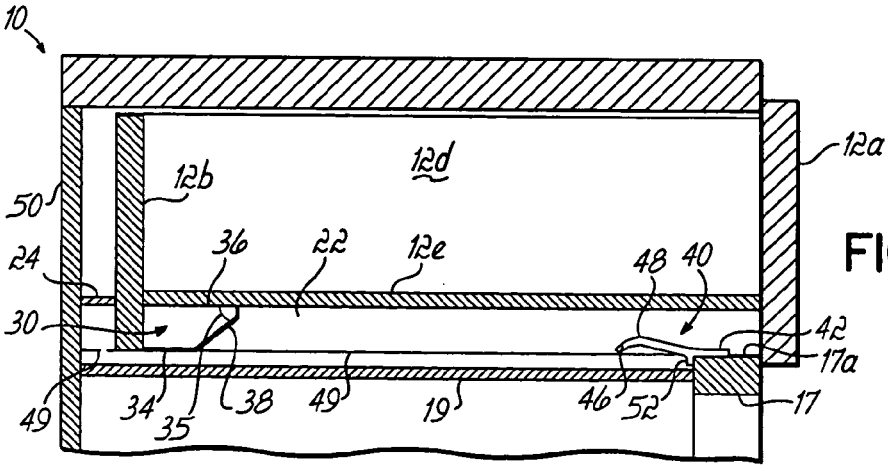
FIG. 2A is a cut-away, close-up perspective view of the partially open drawer illustrated in FIG. 1.
Figure 3:
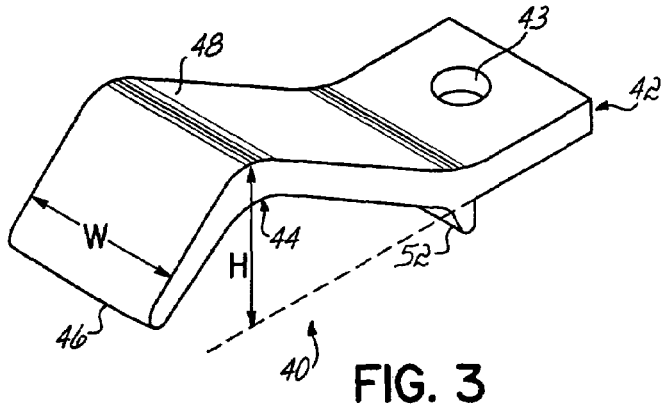
FIG. 3 is a close-up perspective view of the cantilever arm illustrated in FIGS. 2 and 2A.

The drawer stop device illustrated further includes a cantilever arm 40. With reference to FIGS. 2, 2A and 3, cantilever arm 40 generally includes a front mounting section 42 and a rear deflectable section 44 (FIG. 3). Centrally located in mounting section 42 is an opening 43 for securing arm 40 to drawer opening 16 with a suitable fastener, such as a screw. As shown in FIGS. 2 and 2A, mounting section 42 is fixedly secured to the lower front frame 17 of drawer opening 16, and deflectable section 44 extends rearwardly toward the rear 50 (FIG. 2A) of dresser 10. Deflectable section 44 includes a free end 46, and a hump 48 located between free end 46 and mounting section 42. As shown, hump 48 is located in the path of the cam surface 38 above the lowermost edge thereof which edge defines the junction of the cam block bottom surface 34 and the cam surface 38.

As illustrated in FIG. 3, cantilever arm 40 further includes a downwardly projecting detent ridge or finger 52 located at the approximate junction of mounting section 42 and deflectable section 44. Detent ridge 52 generally abuts the rear vertical surface of frame member 17, preventing arm 40 from moving forwardly during complete removal of drawer 12 from dresser 10 (FIG. 2A). Detent ridge 52 further serves to minimize or control the bounce back or extent of deflection of cantilever arm 40 during complete removal of drawer 12 from opening 16. However, detent ridge 52 is optional and need not be part of cantilever arm 40. Other independent structures to accomplish these functions may be utilized.

Cantilever arm 40 illustrated in FIG. 3 is generally flexible and deflectable and formed of a resilient material such as polyurethane or like polymeric or other material. Arm 40 should not be formed of a material susceptible to breaking, fracturing or crumbling under drawer removal forces exceeding those of normal drawer-opening magnitude. As illustrated, arm 40 of the preferred embodiment has the following approximate dimensions. The total length of arm 40 is about 57 mm, with about 14 mm comprising the front mounting section 42, about 3 mm of length comprising the portion having detent ridge 52 integrally connected thereto, and the remaining about 40 mm comprising the deflectable section 44. The thickness of arm 40 can vary. As shown in the preferred embodiment, mounting section 42 is about 3 mm thick, while the uppermost portion of the curved humped 48 is about 4 mm thick. Opening 43 in mounting section 42 is about 4-5 mm in diameter. The height H of hump 48, as measured between the plane of the underside of mounting section 42 and the top side of hump 48, is about 16 mm. The transverse width W of the arm is approximately 16 mm. While arm 40 illustrated in FIGS. 1-5 is so dimensioned, the dimensions and shape of arm 40 may vary as desired, as appreciated by those skilled in the art.

Figure 4:
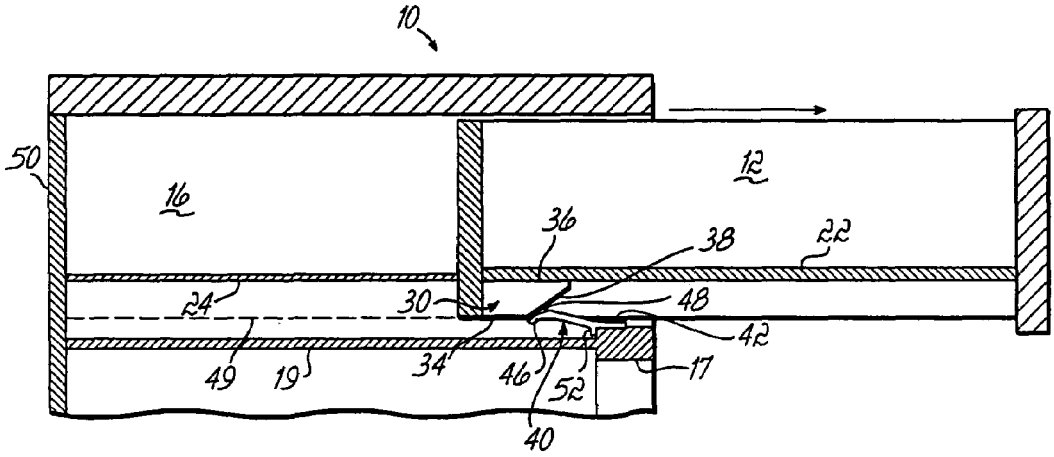
FIG. 4 is a cut-away, cross-sectional side view of the drawer illustrated in FIG. 2 at an extended open position.

With reference to FIG. 4, there is illustrated drawer 12, fitted with the exemplary drawer stop device illustrated in FIGS. 1 and 2, at an extended open position within furniture 10. Block 30 being positioned at the rear of drawer 12 permits drawer 12 to be extended outward, external to drawer opening 16, a major portion of its path along the rail 24 (FIG. 2) to the normal, fully open position, 16, thereby allowing access to the interior of drawer 12 and contents therein. Further opening of drawer 12 and/or complete removal thereof is restrained by mechanical interference between the lower portion of inclined front cam surface 38 of cam block 30 and the upper surface of hump 48. Accordingly, accidental and/or inadvertent complete withdrawal of drawer 12 from drawer opening 16 under normal drawer-opening force, and potential harm from such occurrence, is averted.

Figure 5:
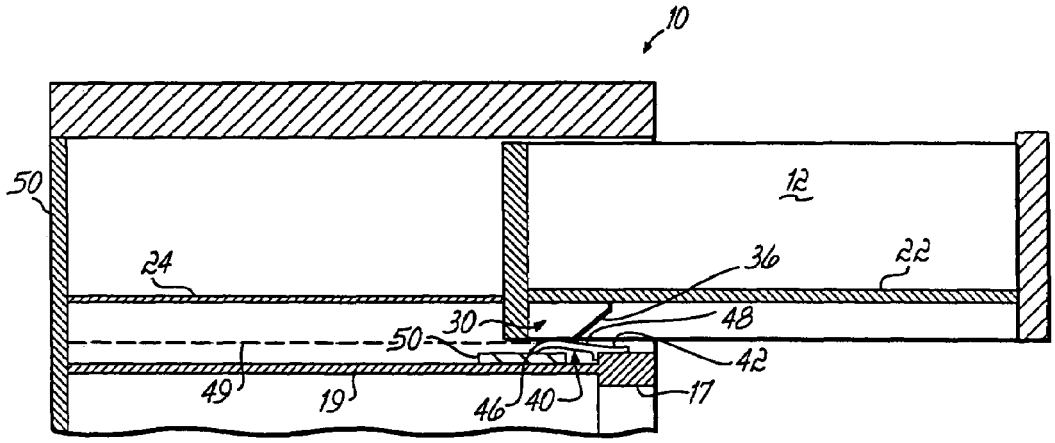
FIG. 5 is a cross-sectional view of the drawer illustrated in FIG. 4 in a further extended position illustrating the mechanism of action of a second exemplary embodiment of the drawer stop device.

To completely withdraw drawer 12 from opening 16, it is necessary to overcome the resistance or restraint of further drawer opening, caused by the mechanically interfering hump 48 and cam surface 38. With reference to FIG. 5, additional outward pulling force must be exerted upon drawer 12 sufficient in magnitude to enable cam surface 38 to cam downward cantilever arm 40 such that hump 48 contacts and slides along bottom surface 34 (FIG. 4) of block 30. Thus, cantilever arm 40 is deflected downward by cam surface 38, allowing complete removal of drawer 12 from opening 16 in dresser 10. Similarly, to return the fully withdrawn drawer 12 back into dresser 10, a drawer-pushing force is applied to the drawer front 12*a* sufficient to enable the rear drawer wall 12*b* to cam or deflect cantilever arm 40 in a downward direction such that the hump 48 passes below the lower edge of the door rear wall 12*b* and the bottom surface 34 of the cam block.

This new drawer stop mechanism provides benefits over previously proposed mechanisms. Particularly, the downward deflection of cantilever arm 40 prevents the user from having to tilt drawer 12 downwards to allow block 30 to clear the hump 48 of cantilever arm 40 for complete withdrawal of drawer 12 from opening 16. Accordingly, only a small clearance between the upper edges of drawer sides 12*c* and 12*d* 12 and the dustpan 19 or similar frame of the drawer opening 16 immediately above the drawer is all that is necessary for reciprocally movable drawer 12 in dresser 10 between a fully withdrawn position and an inserted position. Consequently, less height is required to satisfactorily support drawer 12, thereby providing a savings in space and cost.

Moreover, one may adjust the maximum pulling force necessary to completely withdraw drawer 12 from dresser 10. The additional withdrawal force necessary to completely remove drawer 12 from dresser 10 is generally influenced by the dimensions and/or properties of the two interacting drawer stop device components, i.e., the cam block 30 and cantilever arm 40. For example, increasing angle 35 of the front cam surface 38 of block 30 generally increases the maximum drawer-removal force required to completely remove drawer 12, making drawer removal force more difficult. Similarly, decreasing angle 35 decreases the maximum withdrawal force required to remove the drawer. In the same fashion, reducing the radius of the curvature of the upwardly extending hump 48 or increasing its overall height relative mounting section 42 generally increases the maximum drawer removal force, making it harder to completely remove drawer 12 from dresser 10. Accordingly, an increase in the radius of curvature of hump 48 or a decrease in height of the hump generally reduces the necessary maximum force to fully remove drawer 12 from dresser 10. Thus, simple adjustment of the dimensions and location of the cam 30 and/or arm 40 may also lead to "child-proofing" drawer 12 as well, if so desired.

Depending upon physical nature and material properties of cantilever arm 40, the mechanism by which the drawer stop device of the present invention operates may vary. For example, if the cantilever arm is made of a relatively stiff material, arm 40 will only deflect in response to cam forces applied to the arm hump 48 by block 30 when the drawer is removed. However, with less stiff materials, hump 48 may move downwardly as a result of a combination of arm deflection and hump flattening to allow forcible removal of drawer 12 at lesser maximum forces than possible with stiffer arm materials. Similarly, increasing the smoothness of the curved hump 48 and its distance from mounting section 42 generally influences the degree of flexibility and deflectability of arm 40, reducing the maximum drawer removal force required. These physical attributes also affect the ability of the curved portion of the arm 40 to flatten during complete removal of drawer 12 from dresser 10. Accordingly, while "flattening" of arm 40 of the curved portion is different from mere arm "deflection", both mechanisms are contemplated herein.

FIG. 5 further illustrates an embodiment wherein the drawer stop device further includes an additional structural component, namely, a deflection-limiting stop block 50. Block 50 is generally positioned to contact the free end 46 of deflectable section 44 during deflection of cantilever arm 40. Block 50 may be formed of any desired material. In the embodiment illustrated, block 50 is formed of a solid, nonresilient material, such as wood, and mounted on the dust panel 19, which forms the lower surface of drawer opening 16. Block 50 generally serves to prevent bounce back motion of arm 40 during and after deflection. It also limits the downward travel of the free end 46 of the deflectable section 44 to control the force needed to fully withdraw the drawer from opening 16. Accordingly, it should be understood that the clearance between free end 46 of arm 40, in its normal disposition with the drawer closed, and the upper surface of block 50 contacted by free arm end 46, should be sufficient to allow the downward deflection of arm 40 necessary to enable drawer 12 to be completely withdrawn from opening 16.

Block 50 is optional and need not be included as a component of the present drawer stop device. Particularly, as further contemplated herein, the free end 46 of rear deflectable section 44 of cantilever arm 40 may be elongated in a downwardly direction from hump 48 such that free end 46 extends and contacts dust panel 19 directly, upon downward deflection of arm 40 during removal of the drawer 12 from opening 16 in dresser 10. In a manner similar to that of As provided by block 50, bounce back motion of arm 40, as well as control of required withdrawal force, can be varied, as desired, by varying the downward elongation of free end 46, such that it contacts the dust panel when the drawer is moved to its normal open position, but prior to complete withdrawal of the drawer.

While the present invention has been illustrated by the description of preferred embodiments thereof, and while the embodiments have been described in considerable detail, it is not intended to restrict or in any way limit the scope of the appended claims to such detail. Additional advantages and modifications will be readily apparent to those skilled in the art. For example, the cam of the drawer stop device may be any desired shape, as long as it includes an inclined front cam surface which is configured the patient engage the arm hump when the drawer is moved to its normal open position to inhibit, but not prevent full removal, and to slidably engage and depress the hump of the cantilever arm below the cam to facilitate complete removal of the drawer. Therefore, the invention in its broader aspects is therefore not limited to the specific details, representative apparatus and method, and illustrated examples described. Accordingly, departures may be made from such details without departing from the scope or spirit of Applicant's inventive concept.

What is claimed is:

1. A drawer stop device comprising:

a cam adapted to be attached to the underside of a drawer, the cam having an inclined cam surface;

a cantilever arm including a generally planar mounting section and an arcuate tongue extending outwardly from the mounting section, the mounting section adapted to be secured to a lower frame member of a drawer opening such that the tongue is cantilevered inwardly of the drawer opening;

the cantilever arm cooperates with the cam, when the cantilever arm is installed on the frame member and the cam is installed on the drawer such that the cantilever arm is positioned in the path of travel of the cam, to permit free sliding movement of the drawer relative to the frame member until the inclined cam surface engages the cantilever arm at an open position of the drawer, and to limit further movement of the drawer until a force is applied to move the cam surface over the tongue to thereby enable withdrawal of the drawer from the drawer opening; and a stop member stationarily positionable on the lower frame member of the drawer opening below the arcuate tongue of the cantilever arm to limit the downward movement of the arcuate tongue when the drawer has been withdrawn to its fully normal open position to control the force required to fully withdraw the drawer from the drawer opening.

2. The device of claim 1 wherein the stop member is a wooden block.

3. A furniture assembly comprising:

at least one drawer opening defined in part by a lower frame member;

at least one drawer movable between a closed position, a normally fully open position, and a removed position fully withdrawn from the drawer opening; and a drawer stop device including:

a cam attached to the underside of the at least one drawer, the cam having a rearwardly and downwardly front facing cam surface; and a cantilever arm having a front mounting section attached to the lower frame member of the drawer opening and a rear deflectable section terminating in a free end, the deflectable section having an upwardly extending hump located between the free end and the mounting section, wherein the hump of the cantilever arm is positioned in the path of travel of the front cam surface of the cam when the drawer is opened and such that the front cam surface of the cam frictionally engages the hump of the cantilever arm when the drawer is at its extended normal open position from the drawer opening under normal drawer opening forces and deflects the cantilever arm downward allowing the cantilever arm hump to slide along a bottom surface of the cam when forces are applied to the drawer in excess of normal drawer opening forces, thereby enabling complete withdrawal of the drawer from the opening.

4. The assembly of claim 3 wherein the cam is a block having a bottom surface and a rearwardly and downwardly inclined front cam surface.

5. The assembly of claim 4 wherein the inclined front surface of the block is substantially planar.

6. The assembly of claim 4 wherein the block is formed of a substantially non-compressible material.

7. The assembly of claim 4 wherein the block is formed of wood.

8. The assembly of claim 4 wherein the inclined front cam surface of the block is inclined relative the bottom surface of the drawer at an included angle ranging from about 30° to about 50°.

9. The assembly of claim 8 wherein said angle is about 30°.

10. The assembly of claim 4 wherein the cantilever arm further includes an integral downwardly extending finger located proximate a junction of the front mounting section and the rear deflectable section of the arm.

11. A furniture assembly comprising:

at least one drawer opening defined in part by a lower frame member;

at least one drawer movable between a closed position, a normally fully open position, and a removed position fully withdrawn from the drawer opening; and a drawer stop device including:

a cam attached to the underside of a drawer, the cam having a rearwardly and downwardly front facing cam surface;

a cantilever arm having a front mounting section attached to the lower frame member of the drawer opening and a rear deflectable section terminating in a free end, the deflectable section having an upwardly extending hump located between the free end and the mounting section, wherein the hump of the cantilever arm is positioned in the path of travel of the front cam surface of the cam when the drawer is opened and such that the front cam surface of the cam frictionally engages the hump of the cantilever arm when the drawer is at its extended normal open position from the drawer opening under normal drawer opening forces and deflects the cantilever arm downward allowing the cantilever arm hump to slide along a bottom surface of the cam when forces are applied to the drawer in excess of normal drawer opening forces, thereby enabling complete withdrawal of the drawer from the opening; and a stop member stationarily positioned on the lower frame member of the drawer opening below the free end of the deflectable section of the cantilever arm to limit the downward movement of the free end of the cantilever arm when the drawer has been withdrawn to its fully normal open position to control the force required to fully withdraw the drawer from the drawer opening.

12. The assembly of claim 11 wherein the stop member is a wooden block.

13. The assembly of claim 4 selected from the group consisting of a dresser, a cabinet, a hutch, a night table, a coffee table, a desk, and an entertainment center.

* * * * *